US005089032A

United States Patent [19]

Moran

[11] Patent Number: 5,089,032

[45] Date of Patent: Feb. 18, 1992

[54] GRINDING WHEEL

[76] Inventor: Joseph F. Moran, 510 Carmarthen Dr., Exton, Pa. 19431

[21] Appl. No.: 548,099

[22] Filed: Jul. 5, 1990

[51] Int. Cl.[5] ..... B24D 3/00

[52] U.S. Cl. ..... 51/293; 51/295; 51/298; 51/309

[58] Field of Search ..... 51/293, 295, 298, 309

[56] References Cited

U.S. PATENT DOCUMENTS

| | | | |
|---|---|---|---|
| 4,099,934 | 7/1978 | Suzuki et al. | 51/295 |
| 4,133,144 | 1/1979 | Early | 51/295 |
| 4,369,046 | 1/1983 | Bruscher et al. | 51/298 |
| 4,404,003 | 9/1983 | Harris | 51/298 |
| 4,459,779 | 7/1984 | Shen | 51/296 |
| 4,523,930 | 6/1985 | Williston | 51/293 |
| 4,541,843 | 9/1985 | Elbel et al. | 51/298 |
| 4,553,982 | 11/1985 | Korbel et al. | 51/298 |
| 4,561,863 | 12/1985 | Hashimoto et al. | 51/295 |
| 4,588,420 | 5/1986 | Charvat | 51/298 |
| 4,615,151 | 10/1986 | Huber et al. | 51/293 |

*Primary Examiner*—William R. Dixon, Jr.
*Assistant Examiner*—Willie J. Thompson
*Attorney, Agent, or Firm*—John F. A. Earley; John F. A. Earley, III

[57] ABSTRACT

Grinding wheels are constructed with an improved type of resin binder of a low molecular weight solid epoxy resin. The epoxy resin is in the form of a fine powder and may be mixed with other wheel components such as abrasive grain, wetting agent and fillers. A method in which the epoxy resin and curing agents are processed from their commercially available forms to that most suitable for use as a grinding wheel binder.

23 Claims, 1 Drawing Sheet

GRINDING WHEEL

FIELD OF THE INVENTION

This invention relates to grinding wheels, and more particularly concerns a grinding wheel having an improved resin binder of low molecular weight solid epoxy resin.

BACKGROUND OF THE INVENTION

About half of all grinding wheels made are vitrified bonded, and most of the rest are phenolic resin bonded. Wheels formulated with a liquid epoxy resin bond are the latest development. Liquid epoxy resin has superior physical characteristics as compared to phenolic resin. Among other aspects, it has higher tensile strength, less brittleness, more heat resistance, extra adhesion and better resistance to coolants. Powdered phenolic resin, however, is much easier to use in the production of wheels, and so is better suited for making a wide variety of wheel formulations.

The term "grinding wheels" refers to hard grinding elements including the standard wheel shape, cup wheel shape, mounted point shape, honing stone shape, etc. Grinding wheels are made of abrasive grains held together in a matrix by a binding material or ingredient.

The main binding ingredient is usually classified as being inorganic or organic. Inorganic binders include ceramic (vitrified) and oxychloride (magnesite). Organic binders include resins such as phenolic, shellac, epoxy, polyester and rubber. In some cases, the binder may be a combination, such as a phenolic resin and rubber. Different applications may require different binding materials.

In addition to the main binder material, other materials or fillers are often incorporated in a wheel formulation. These may be for the purpose of increased wheel strength, lubrication at the point of grind, prevention of steel chips welding to wheel face, or other such processing and operating benefits.

The major operations in the manufacturing of grinding wheels are: mixing the ingredients, molding them, firing them, and finishing them. Mixing is the operation of weighing raw materials, combining them in a mixing machine, screening them, and related steps prior to molding. Molding is the operation of placing the mix of raw materials in a steel form, and then leveling and pressing the mix to the desired thickness to form a "green" wheel which may be handled without falling apart. Firing or curing is the operation of applying heat in a kiln or oven to the molded "green" wheel in order to fuse an inorganic bond or polymerize an organic bond and producing a grinding wheel which is then cooled. Finishing is the operation of trimming the hardened wheel so as to remove material in excess of the desired final size.

The combined raw material mix for the grinding wheel generally can be classified as being dry, liquid (fluid or viscous), or a resilient solid. Most grinding wheels, whether inorganic or organic bonded, are produced from a dry mix. The abrasive grain is wetted thinly with a wetting agent—a solvent and/or resinous liquid—and then blended with a powdered binder. The binder is slightly dissolved by the wetting agent and adheres to each abrasive grain as a coating.

Inorganic or organic bonded wheels of a more specialized nature are produced from a liquid mix. The abrasive grain is coated with a mainly liquid binder.

Rubber bonded wheels are produced from slabs of resilient rubber impregnated with abrasive grain and fillers. This type of grinding wheel with a rubber mix is a minor one and has become more so in recent years.

The dry mix process of making grinding wheels generally is regarded as the most efficient and that is the reason for its predominance in the industry. It offers production and consistency advantages unmatched by the less used alternative liquid mix process.

The main production advantage of the dry mix process lies in its suitability for automation of mixing and molding. As a consequence, the labor content of the dry mix process is usually significantly lower than that with the liquid method. Large batches of powdered mix may be blended with ease in any of a number of common type industrial mixers. Because all ingredients, except for a small amount of wetting agent, are dry, the handling of them before and after mixing offers little difficulty. The equipment, including material pans, mixer blades, mixer chamber, chutes and the like, remains dry and relatively clean.

The liquid method, in most cases, does not lend itself to the same level of mixing automation, and requires more labor and complex equipment. Liquid epoxies, urethanes and some phenolics generally require the addition of curing agents, accelerators and the like. Precise proportions must be maintained. Most curing agents and accelerators are liquid, and they start resin advancement when added. Because of the viscosity, proportion sensitivity, and resin advancement, volume wheel production requires sophisticated component metering and mixing equipment. Even such equipment, however, cannot avoid many problems associated with mixing liquids with large quantities of sand-like abrasive grains. Accumulation of viscous materials, especially room temperature curing types, on equipment is a serious problem, and often requires removal by application of hazardous solvents. Wheels can be made by the liquid method by using less automated equipment but at a cost of extra labor and product inconsistency.

The dry molding operation offers labor savings over liquid methods. The dry method of molding is widely used and consists of pouring the free-flowing dry mix into a steel circular mold rotating on its vertical axis. After the proper amount of dry mix has been poured into the mold and leveled, the mold rotation is halted. A steel plate, similar to one already below the mix, is placed on top of the mix. The mold then is transferred into a hydraulic press, and the press is closed onto the mold assembly and exerts great compressive force on the wheel mix. When the mix has been compressed to the desired thickness it forms a "green" wheel, and the press ram retracts and the mold is moved onto a stripping mechanism. The stripper clamps the mold while pushing or stripping the "green" wheel upward from the mold. The mold then is moved back to its original location for the next cycle. This sequence of molding steps often is semi- or fully automatic and requires only a few moments to complete, depending on wheel size. The "green" wheel, after pressing, possesses sufficient "green" or uncured strength to withstand stripping and handling forces. It then is placed on a suitable plate or cart and transported into an oven.

Liquid molding does not have the advantage of using one mold for a rapid succession of wheels. Because the mix is wet or damp, once placed in a mold, it must stay until partly or fully cured. It has no "green" strength. Demolding may be delayed from several hours to over a day, depending on whether heat is applied. If heat is applied, extra time may be needed to cool the mold before cycling again. A number of molds are required even for modest production levels. Although a hydraulic press may not be necessary, other methods such as tamping or rolling are often used to fill the mold properly. Liquid mix must be poured into the mold carefully since trapped air bubbles can affect the quality of the finished wheel. Consistency of finished product is often a problem. If using a reactive mix, the last of the batch will have advanced somewhat by the time it is molded into a wheel. As a consequence, the last wheel of the batch may grind differently from the first.

An important feature of most grinding wheels is the porosity of the structure. Basically, a wheel is comprised of three entities: abrasive grains, a bond coating each grain and attaching it to its neighbor to form a matrix, and voids that exist between the grains of the matrix. The voids perform a useful function in the manufacturing and performance of a properly designed wheel. After curing, their similar size and frequency on all sides of the wheel indicates structure uniformity. Liquid bonded wheels can have the difficulty of the grains sinking to the bottom of the mold, leaving an excess of bonding material on top. The structure would not be considered uniform. During grinding, the voids provide space for metal chips from the object being ground to lodge temporarily. The larger the chips, the larger should be the designed voids. They also provide space for coolant to occupy, and allow the coolant to better reach the area of grind. The dry process naturally produces a porous structure. The liquid process does not, and must include special fillers that, upon burning away, leave voids in their place. The effectiveness of such fillers is often questionable.

A problem with all phenolic formulations, and most liquid epoxy formulations, is the presence of environmentally undesirable compounds. Phenolic resin bonds are based on the simultaneous use of phenolic resoles and phenolic novolacs. During a two-day curing operation at 175 degrees C., significant quantities of free phenol, formaldehyde and ammonia are released into the air. Epoxy resins generally are not an environmental problem but the curing agents can be hazardous. The most commonly used curing agents for liquid epoxies are aliphatic polyamines. These are classified as skin sensitizers, and can cause respiratory difficulties. Aromatic amines also are used for this type product and they are classified similarly as well as being a suspected carcinogen. Reactive diluents used for reducing liquid resin viscosity are sensitizing agents, and must be handled with care. Because of the nature of grinding wheel manufacturing, close physical and respiratory contact with materials in the process is nearly impossible to avoid.

Simply put, the dry process is the most effective method of designing and manufacturing grinding wheels. The resin with the best physical properties, however, is epoxy, which is a liquid in its commonly used form. Both phenolic and liquid epoxy bonds can be hazardous to workers and the environment.

SUMMARY OF THE INVENTION

This invention concerns the development of a dry process but with a unique solid epoxy resin as the binder. In addition, the bond essentially is non-hazardous.

It is an object of this invention to provide a grinding wheel with improved wear resistance, giving added value to the consumer.

It is another object of this invention to provide a wheel of greater strength which may be operated at higher speeds and at heavier grinding pressures.

It is another object of this invention to provide a wheel offering more safety to the consumer due to greater resistance to the softening effect of coolant on the binding material in the wheel.

A further object of this invention is to provide greater protection for wheel manufacturer employees, and to protect the environment by reducing or eliminating the emission of free phenol, formaldehyde and ammonia liberated during the curing of traditional phenolic resin bond wheels. The environment benefits additionally in that the energy required to cure epoxy resin bonded wheels is substantially lower than that for phenol formaldehyde (phenolic) resins.

The above objects are accomplished by the use of a powdered epoxy resin having a low molecular weight (less than 900 epoxide equivalent weight—EEW). Such an epoxy resin, polymerized by an appropriate curing agent and accelerator, functions as a more effective grinding wheel binder than phenolic resin.

In addition to the liquid epoxy binders already discussed, some binders have been made of solid epoxies. These epoxies are currently available from resin manufacturers in powdered form and are used for making light duty type wheels. These resins are of a much higher molecular weight structure, (approx. 900 to 1800 EEW). In addition, some phenolic resin bonds have been formulated with a moderate percentage of higher molecular weight solid epoxy. This epoxy additive has been found to improve the performance of certain type wheels.

The distinction between lower and higher molecular weight solid epoxies is that the lower the EEW, the better are many physical properties such as tensile strength. Resins having a lower EEW, however, also have a lower softening point since their chemical structure more resembles epoxy in its liquid state. Solid epoxies are commercially available most often in the form of thin chips. The chip size varies depending on the resin manufacturer, etc., but is approximately 0.100 inch thick and 0.2 sq inch in area.

To be useful for grinding wheel makers, the chip must be reduced in size to less than 200 mesh. Because of its lower softening point, this is more difficult to do with lower EEW resins. Special equipment and the use of liquid nitrogen while pulverizing is recommended. In addition, the lower softening point precludes the use of common modes of transportation between the resin manufacturer and the user—the wheel manufacturer. A lower molecular weight, EEW, powdered epoxy resin tends to fuse into a solid mass when exposed to high summer temperatures in much of the country. A drum of this powdered material could arrive as a hard lump if transported by truck.

Difficulty in pulverizing and transporting lower EEW powdered epoxies is one reason the solid epoxy resins pertinent to this invention have not been offered to wheel manufacturers for regular and heavy duty grinding wheel product lines. In addition, the wheel formula and bond formula are entirely different from conventional formulas. The proportion by weight of bond to fillers to abrasive grain is considerably different than with conventional wheel formulas. Also, the wheel manufacturing process is different because the lower molecular weight resin has a much lower softening point and a unique curing cycle. Because of the softening point, typical grinding wheel mixing equipment is unsuitable. Friction generated at certain points in the mixing chamber tends to melt part of the mix which then solidifies immediately into small lumps.

The novel wheel bond material comprises a low EEW, solid resin, a curing agent and an accelerator. The resin chips are crushed to a small particle size. The resin, cure agent and accelerator are weighed and then blended together in a ribbon blade mixer. They are then melt mixed in an extruder to form a paste. The extruded paste is discharged in the shape of a continuous strip and is cooled, and crushed to a chip size. The chips are frozen while being fed into a hammer mill type pulverizer and reduced in size to under 200 mesh. Although a number of steps are required to process the raw materials into the wheel bond material, average sized crusher/pulverizers, mixers and extruders process relatively large quantities of bonded material quickly.

The abrasive grains, wetting agents, bond and fillers, if any, are weighed out according to the formula for the wheels being made, and the materials are mixed in a low friction mixer. The amount of mix needed for each wheel is weighed and poured into a rotating steel mold. The wheel mix is then leveled, compressed into the shape of a wheel in the mold, stripped from the mold and placed in an oven, heated and cured in the oven, finished, inspected and marked.

DETAILED DESCRIPTION OF THE INVENTION

Figure 1:
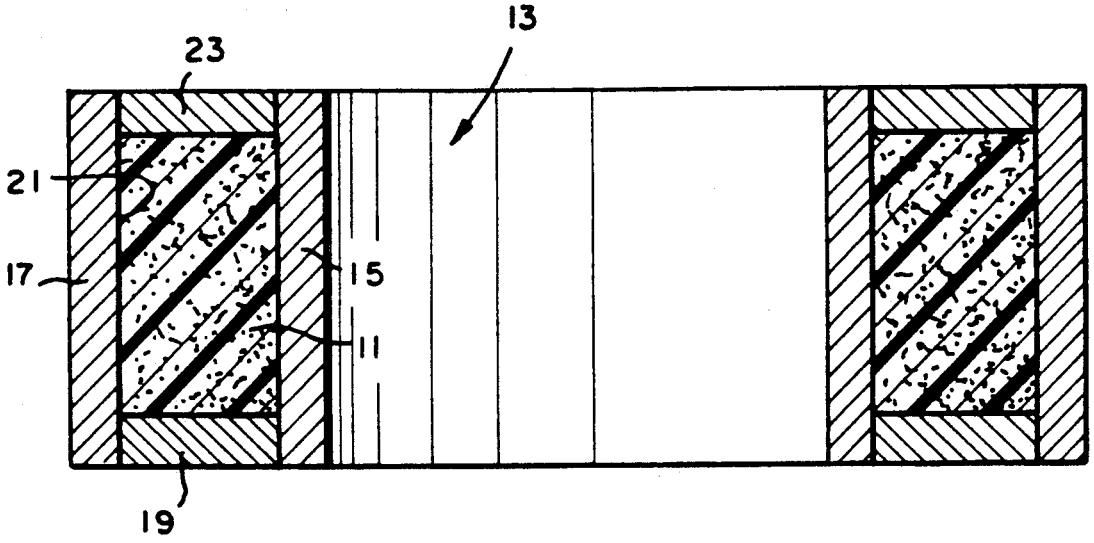
FIG. 1 shows a view in vertical cross section of a mold suitable for making the grinding wheels of the present invention.

A method of making a grinding wheel of the present invention comprises the steps of reducing epoxy resin chips of low molecular weight in the range of 500 to 875 EEW to a powder of less than 60 mesh in a hammer mill, batch mixing the epoxy resin powder with a powdered curing agent and a powdered accelerator to form a mixed powder, heating the mixed powder to the softening point of the epoxy resin, kneading the softened mixed powder while the heat is being applied and forcing the powder particles into close and uniform distribution in the mix to form a hot doughy mix, continuing this kneading action on the hot doughy mix and transporting it through a mixing chamber to a discharge section, discharging the hot doughy mix in the form of a ribbon mix, cooling the ribbon mix, breaking the cooled ribbon mix into thin mix chips, cooling the mix chips, pulverizing the cooled mix chips into a binder mix powder, coating abrasive grains with a wetting agent, mixing the coated grains with the binder mix powder to form a grinding wheel mixture, weighing the grinding wheel mixture to obtain a desired weight, pouring the weighed grinding wheel mixture 11 into a steel mold 13 having an inner circular wall 15 and an outer circular wall 17 and a bottom annular plate 19 which define an annular mold cavity 21, spinning the steel mold 13 on its vertical axis, leveling the grinding wheel mixture 11 in the mold 13, shutting off the spinning of the mold 13, placing a top annular plate 23 on top of the grinding wheel mixture 11 in the mold, compacting the grinding wheel mixture 11 to form a green wheel by applying hydraulic pressure for about one minute to the top plate 23 and bottom plate 19, stripping the green wheel from the mold 13 and placing the green wheel in an oven, curing the green wheel to form a grinding wheel by applying heat to the green wheel in the oven, and cooling the grinding wheel to room temperature.

As discussed above, the binder used comprises a low molecular weight epoxy resin in solid form, a curing agent, and optionally an accelerator.

Chemically, the term epoxy, epoxide in Europe, refers to a resin containing more than one a-epoxy group situated terminally, cyclicly, or internally in a molecule which can be converted to a solid through a thermosetting reaction. The most common solid epoxy categories are DGEBA, phenol novolac and cresol novolac. The solids differ from liquid epoxies in that the solids have higher molecular weights which can range from 500 EEW to 5000 EEW. The novolacs have the advantage of higher functionality and thus a higher density cross-linking potential. There are more epoxy groups per novolac molecule than for an equivalent weight DGEBA molecule.

All three solid epoxy resin types described above have been used in the production of the inventive grinding wheels. Certain categories of wheels benefit most from the physical characteristics particular to one or a blend of the three types of solid epoxy resins. The range of molecular weight selected was from 500 to 875. The preferred resin is Dow Chemical's D.E.R. 642U, a 500 to 560 EEW phenol epoxy novolac resin in solid chip form.

The above resins are hardened by any one of many curing agents. Curing agents are available in liquid and solid forms. Some curing agents begin the polymerization process almost immediately while others are more latent and require the application of heat to harden the epoxy. The preferred curing agent is latent and is Pacific Anchor's Amicure CG-1200, a dicyandiamide in finely powdered form.

Certain resin/curing agent systems require the use of an accelerator in order to reach optimal polymerization or to do so in less time or with less application of heat. For all three reasons, it is advisable to include a curing agent when using an epoxy/dicyandiamide system. The preferred accelerator is Omicron's Omicure 24, an imidizole in powdered form.

The above three bond materials must be combined according to a predetermined ratio and in a manner insuring they have close and uniform physical contact during the curing process. A number of processes may be utilized for the combining of these materials, including dry blending, melt mixing in an extruder and the solution technique.

For a high performance product such as grinding wheels, the melt mixing process is preferred. It is more complex but very effectively combines the bond materials. The steps are as follows.

EXAMPLE 1

Binder Mix

Epoxy chips are reduced to less than 60 mesh by a hammer mill, although a pin wheel type mill may be used. The resultant epoxy powder is batch mixed with the powdered curing agent and accelerator, as follows:

Weight 100 lbs D.E.R. 642U molecular weight 560 epoxy resin (Bis A Type) binder by Dow Chemical 5 lbs Amicure CG-1200 dicyandiamide curing agent by Pacific Anchor 2 lbs Omnicure 24 immidizole accelerator by Omicron The three powders are batch mixed in a ribbon blender. A cone blender, or high intensity mixer may be used for the batch mixing. The mixed powders are then fed into a melt mixer, an extruder, in which the powders are heated to the softening point of the epoxy. While heat is being applied, a mixing screw kneads the softened powders, forcing them into close and uniform distribution. The screw continues this kneading action as it transports the hot, doughy mix through the screw mixing chamber toward the discharge section.

At the discharge end of the mixer, the mix is forced into a ribbon shape by a die and it is discharged and then chilled by passing it through a set of two chilled rolls. The rotating rolls cool the ribbon mix sufficiently, and it is broken into thin chips by a granulator. The chips of the epoxy mix are then pulverized by a hammer pulverizer into powder. Due to the heat sensitivity of this material and the small particle size required, a hammer mill is preferred but a pin-wheel type pulverizer may be used. The chips may be cooled by liquid nitrogen while being pulverized in order to increase the speed of the material through the pulverizer, the thruput, and insure powder fineness.

Grinding wheel formulas vary greatly depending on the requirements of the job to be done, but all the inventive formulas include the low molecular weight epoxy resin same and distinguishes this invention from conventional grinding wheel formulations. A particular formula involves the selection of an abrasive material, a bond material, a filler material, if any, and a wetting agent. In addition, the proportions of these ingredients vary according to the purpose of the wheel. In-house and field tests have shown that the following formula proves very successful when used for centerless grinding of stainless steel bars. The wheel size is 20 inches outside diameter × 6 inches thick × 12 inches inside diameter and it weighs 81.81 lbs after being trimmed.

EXAMPLE 2

Grinding Wheel

| | Weight |
|---|---|
| silicon carbide abrasive grains | 82.76 parts |
| D.E.R. 642U epoxy resin binding material by Dow Chemical | 16.11 parts |
| Amicure CG-1200 dicyandiamide curing agent by Pacific Anchor | .81 parts |
| Omicure 24 immidizole accelerator by Omicron Chemicals, Inc., Hackettstown, NJ | .32 parts |
| | 100.00 |
| wetting agent = 1% of grain weight | 8.28 |

EXAMPLE 3

Grinding Wheel

| | Weight |
|---|---|
| silicon carbide abrasive grains | 70.50 lbs. |
| D.E.R. 642U epoxy resin binding material by Dow Chemical | 13.73 lbs. |
| Amicure CG-1200 dicyandiamide curing agent by Pacific Anchor | .69 lbs. |
| Omicure 24 immidizole accelerator by Omicron Chemicals, Inc., Hackettstown, NJ | .27 lbs. |
| Union Carbide Organofunctional Silane A 187 ¾% of the silicon carbide | 238 grams |
| Neutral Oil, C-4 Neutral Oil X-2 by Coopers Creek Chemical Corp., West Conshohocken, PA ¼% of the Silicon Carbide | 79 grams |

The abrasive grain is coated with the wetting agent and then mixed with the powdered bond materials, the epoxy resin, curing agent, and accelerator. The wheel mix is then weighed, poured into a steel mold, leveled and then compacted in a hydraulic press to form a "green" wheel. Pressure necessary to compress the mix to the specified thickness is in the range of 1.5 tons per square inch of the top surface area of the wheel as it sits in the mold. The above wheel requires 300 tons of pressure. The green wheel is stripped from the mold and placed in an oven.

The wheel is cured in the oven and the oven cure cycle runs 23 hours and the temperature of the oven is about 350 degrees F.

By comparison, a cure cycle for phenolic wheels of this size runs from 48 to 66 hours and the temperature of the oven is 370 degrees F. A cure cycle for vitrified wheels of this size runs from 96 to 120 hours and reaches 2300 degrees F.

After the grinding wheel is cured, it is removed from the oven and cooled to room temperature.

Results of tests involving the above wheel as used on a centerless grinding machine and grinding ⅜ inch diameter. × 12 foot long bars of type 303 stainless steel are:

thrufeed of bar—48 feet per minute stock removal of bar—0.005 inches wheel loss per bar—0.0004 inches The thrufeed rate was extremely high compared to what is commonly experienced with conventional wheels. At a removal rate of 0.005 inch per bar, common practice is to set the thrufeed of the bar at 12 feet or at most, 24 feet. Above that, a wheel usually breaks down or wears at an excessive rate. The innovative wheel, however, maintains its integrity better by keeping the individual abrasive grains from being pulled from the wheel matrix prematurely. This could be attributed to the higher tensile strength and higher heat resistance of the lower molecular weight epoxy bond compared to the traditional phenolic bond commonly used for this type application.

A comparison of typical resin properties is as follows:

| | Inventive EPOXY (novolac) | Conventional PHENOLIC |
|---|---|---|
| tensile strength, | 14 max | 7.5 max |

-continued

| | Inventive EPOXY (novolac) | Conventional PHENOLIC |
|---|---|---|
| 1000 psi | | |
| elongation, in 2 in., % | 2-5 | neglig. |
| hardness, Rockwell | M90-110 | M105-120 |
| impact strength, Izod, ft-lb | 0.2-1.5 | 0.2-0.6 |
| flexural strength, 1000 psi | 8-20 | 7-12 |
| heat distortion temp, F. | 500 | 300-350 |

ADVANTAGES

This construction combines the manufacturing efficiencies of the dry phenolic resin process with the superior physical properties of the liquid epoxy resin process. It also has another advantage, that of minimal environmental impact—unlike either the traditional dry phenolic or the liquid epoxy resin processes which may emit hazardous gases or must be cleaned by hazardous solvents.

I claim:

1. A method comprising the steps of reducing epoxy resin chips of low molecular weight in the range of 500 to 875 to a powder of less than 60 mesh in a hammer mill, batch mixing the epoxy resin powder with a powdered curing agent and a powdered accelerator to form a mixed powder, heating the mixed powder to the softening point of the epoxy resin, kneading the softened mixed powder while the heat is being applied and forcing the powder particles into close and/uniform distribution in the mix to form a hot doughy mix, continuing this kneading action on the hot doughy mix and transporting it through a mixing chamber to a discharge section, discharging the hot doughy mix in the form of a ribbon mix, cooling the ribbon mix, breaking the cooled ribbon mix into thin mix chips, cooling the mix chips, pulverizing the cooled mix chips into a binder mix powder, coating abrasive grains with a wetting agent, mixing the coated grains with the binder mix powder to form a grinding wheel mixture, weighing the grinding wheel mixture to obtain a desired weight, pouring the weighed grinding wheel mixture into a steel mold spinning on a vertical axis, leveling the grinding wheel mixture in the mold, shutting off the spinning of the mold, compacting the grinding wheel mixture to form a green wheel by applying hydraulic pressure for about one minute as it sits in the mold to form a green wheel, stripping the green wheel from the mold and placing the green wheel in an oven, curing the green wheel to form a grinding wheel by applying heat to the green wheel in the oven, and cooling the grinding wheel to room temperature.

2. The method of claim 1, wherein the epoxy resin chips being 100 pounds of epoxy resin (Bis A Type), about 500 to 560 molecular weight.

3. The method of claim 1, wherein the epoxy resin chips having a molecular weight in the range of about 500 to 875 EEW.

4. The method of claim 1, wherein the curing agent being 5 pounds of dicyandiamide.

5. The method of claim 1, wherein the accelerator being 2 pounds of immidizole.

6. The method of claim 1, wherein the formula for the grinding wheel comprises by weight 82.76 parts silicon carbide abrasive grains,
16.11 parts epoxy resin binder powder,
0.81 parts dicyandiamide curing agent powder,
0.32 parts immidizole accelerator powder,
8.28 parts wetting agent.

7. The method of claim 1, wherein the formula for the binder mix comprises 100 pounds epoxy resin binder powder,
5 pounds dicyandiamide curing agent powder,
2 pounds immidizole accelerator powder.

8. The method of claim 1, including applying liquid nitrogen to the cooled mixed chips during the step of pulverizing the mix chips to a binder mix powder.

9. The grinding wheel made by the method of claim 1.

10. The grinding wheel made by the method of claim 2.

11. The grinding wheel made by the method of claim 3.

12. The grinding wheel made by the method of claim 4.

13. The grinding wheel made by the method of claim 5.

14. The grinding wheel made by the method of claim 6.

15. The grinding wheel made by the method of claim 7.

16. The grinding wheel made by the method of claim 8.

17. A grinding wheel comprising 82.76 parts silicon carbide abrasive grains,
16.11 parts epoxy resin binder powder,
0.81 parts dicyandiamide curing agent powder,
0.32 parts immidizole accelerator powder,
8.28 parts wetting agent.

18. A grinding wheel comprising 100 pounds epoxy resin binder powder,
5 pounds dicyandiamide curing agent powder,
2 pounds immidizole accelerator powder.

19. A method comprising the steps of providing epoxy resin chips of low molecular weight under 900 EEW in the form of a powder.

mixing the epoxy resin powder with a curing agent to form a mixed powder, taking abrasive grains and boating them with a wetting agent, mixing the coated grains with the binder mix powder to form a grinding wheel mixture, pouring the grinding wheel mixture into a mold, compacting the grinding wheel mixture to form a green wheel, curing the green wheel to form a grinding wheel by applying heat to the green wheel in an oven, and cooling the grinding wheel to room temperature.

20. A grinding wheel comprising a mixture of grains of an abrasive material, an epoxy resin binder powder having a low EEW, and a curing agent.

21. The grinding wheel of claim 20, including an accelerator.

22. The grinding wheel of claim 20, including a wetting agent.

23. The grinding wheel of claim 20, wherein the EEW of the epoxy resin binder powder is less than 900 EEW.

* * * * *